US006389763B1

(12) United States Patent
Clauss

(10) Patent No.: US 6,389,763 B1
(45) Date of Patent: May 21, 2002

(54) SYSTEM AND METHOD FOR TRIMMING A WINDOW OR DOOR

(76) Inventor: Joseph Clauss, 1 Pauline W. Ave., Fort Washington, PA (US) 19034

( * ) Notice: Subject to any disclaimer, the term of this patent is extended or adjusted under 35 U.S.C. 154(b) by 0 days.

(21) Appl. No.: 09/659,044

(22) Filed: Sep. 11, 2000

(51) Int. Cl.[7] ..... E06B 3/30

(52) U.S. Cl. ..... 52/204.53; 52/217; 52/210; 52/211; 52/213; 49/504; 49/505

(58) Field of Search ..... 52/210, 211, 213, 52/217; 49/504, 505

(56) References Cited

U.S. PATENT DOCUMENTS

| | | | | | |
|---|---|---|---|---|---|
| 4,280,309 | A | * | 7/1981 | Huelsekopf | 52/212 |
| 4,387,545 | A | * | 6/1983 | Kern | 52/455 |
| 4,407,100 | A | * | 10/1983 | Huelsekopf | 52/212 |
| 4,726,148 | A | * | 2/1988 | Tix | 49/453 |
| 4,811,533 | A | * | 3/1989 | Wetsel | 52/211 |
| 5,265,388 | A | | 11/1993 | Sherwood | 52/213 |
| 5,644,881 | A | | 7/1997 | Neilly | 52/455 |
| 5,791,104 | A | | 8/1998 | Baier et al. | 52/217 |
| 5,839,234 | A | | 11/1998 | Mayer | 52/213 |
| 5,857,299 | A | * | 1/1999 | Gyllenberg et al. | 52/217 |
| 6,044,611 | A | * | 4/2000 | Brunett | 52/656.5 |
| 6,141,922 | A | * | 11/2000 | Carlisle et al. | 52/204.1 |
| 6,173,542 | B1 | * | 1/2001 | Wright | 52/211 |

* cited by examiner

*Primary Examiner*—Carl D. Friedman
*Assistant Examiner*—Christy Green
(74) *Attorney, Agent, or Firm*—LaMorte & Associates

(57) ABSTRACT

A system and method for installing trim around a window in a construction application where the jambs of the window are not as wide as the wall in which the window is being installed. The system uses jamb mounting elements attached to the jambs of the window. Trim mounting elements are either attached to the trim or its functional equivalents milled into the wood of the trim. When the trim is mounted to the wall surrounding the window, the jamb mounting elements and the trim mounting elements overlap, thereby eliminating any gaps between the trim and the jambs of the window. By overlapping the jamb mounting elements and the trim mounting elements, these two elements can be adapted to fill in the gaps between the trim and the window jambs across a large range.

12 Claims, 4 Drawing Sheets

SYSTEM AND METHOD FOR TRIMMING A WINDOW OR DOOR

BACKGROUND OF THE INVENTION

1. Field of the Invention

In general, the present invention relates to the installation of windows and doors. More particularly, the present invention relates to systems and methods for trimming a window or door after it has been installed in a wall that has a thickness that differs from that of the jamb of the window or door.

2. Description of the Prior Art

In modern construction, windows and doors are typically bought as preassembled units. The windows and doors are then installed into rough framed openings that are constructed in the walls of a building. Once the window or door is installed, trim is applied to the wall surrounding the window or door. The trim covers the jamb surrounding the window or door and provides an aesthetically pleasing transition between the construction of the window or door jamb and the wall.

Windows and doors are manufactured with jambs that have a plurality of different thicknesses. In this manner, the thickness of the window or door jamb can be matched to the thickness of the wall in which the window or door is being installed. When the jamb of a window or door matches the thickness of the wall in which it is installed, the jamb of the window or door terminates in the same plane as does the face of the wall. In other words, the jamb of the window or door lays flush with the wall. In such a circumstance, the window or door is very easy to trim. Trim is simply nailed to the frame of the window or door, wherein the trim overlaps both the jamb and the face of the wall surrounding the jamb.

However, the framework within walls are most commonly built from lumber. Lumber used in framing a wall is seldom cut to exacting tolerances. Furthermore, lumber warps, shrinks, and expands after it is cut. Consequently, when a construction crew frames a wall using lumber, the wall is seldom the exact thickness that one would hope it would be. As a result, when window frames and door frames are placed into a wall, it is not uncommon for the wall to terminate in a plane that is different from the jamb of the window or door.

If the jambs of a window or door are thicker than the wall, the jamb can be cut to match the contour of the wall. However, when the thickness of a wall is greater than that of a window jamb or door jamb, wood must be measured, cut and added to the jambs. Alternatively, the wall must be made thinner by shaving or crushing the sheathing used to cover the wall.

A need therefore exists for a simplified system and method of installing trim around a window or a door, align with the wall. This need is met by the present invention as it is described and claimed below.

SUMMARY OF THE INVENTION

The present invention is a system and method for installing trim around a window in a construction application where the jambs of the window are not as wide as the wall in which the window is being installed. The is system uses jamb mounting elements attached to the jambs of the window. Trim mounting elements are either attached to the trim or its functional equivalents milled into the wood of the trim. When the trim is mounted to the wall surrounding the window, the jamb mounting elements and the trim mounting elements overlap, thereby eliminating any gaps between the trim and the jambs of the window. By overlapping the jamb mounting elements and the trim mounting elements, these two elements can be adapted to fill in the gaps between the trim and the window jambs across a large range.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention system and method can be used for the installation of any premanufactured door that is pre-hung in a jamb, the present invention system and method are especially well suited for use in the installation of premanufactured windows. As such, by way of example, the present invention system and method will be described in an application where they are used to install trim around a premanufactured window. Such an application is merely exemplary and is presented as the most likely use of the invention.

Figure 1:
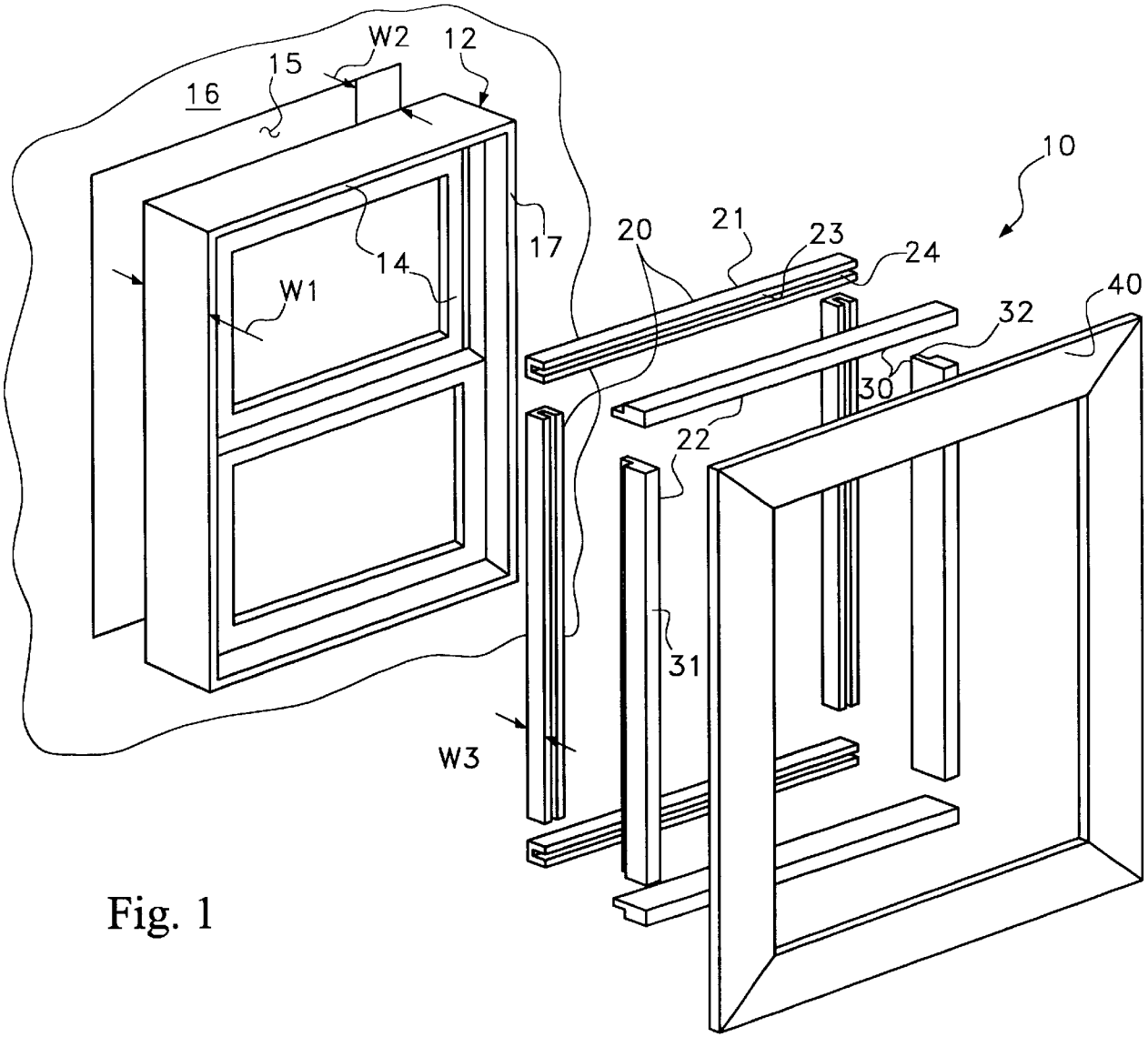
FIG. 1 is an exploded perspective view of an exemplary embodiment of the present invention system shown in conjunction with a window and a framework of trim.

Referring to FIG. 1, an exemplary embodiment of the present invention system 10 is shown in conjunction with a preassembled window 12. The window 12 is manufactured as a complete assembled unit with a surrounding jamb 14 that is used to mount the window 12 in a wall opening 15. The jamb 14 has a predetermined width W1 which is selected to match the wall thickness of a wall 16 that is fabricated using modern lumber and sheathing dimensions. However, due to variances in lumber and carpentry techniques, a wall 16 may have a width W2 that is wider than the width W1 of the window jamb 14. Furthermore, the discrepancies in widths between the window jamb 14 and the wall 16 may vary from place to place. For example, when the window 12 is installed, the window jamb 14 may be one inch shy of the face of the wall, as measured from the top of the window 12, but two inches shy of the face of the wall, as measured from the bottom of the window 12. The present invention is a jamb extension system and method that selectively extends the jambs 14 of the window 12 so that the jambs 14 of the window 12 terminate in the same plane as the face surface of the wall 16. The jamb extension system 10 is a multi-component system consisting of jamb mounted elements 20 and trim mounted elements 22.

The jamb mounting elements 20 are elements that mount directly to the jambs 14 of the window 12. Each jamb mounting element 20, accounting for corner overlap, has the same length as the section of the window jamb 14 that the jamb mounting element 20 is covering. The jamb mounting elements 20 are screwed, nailed and/or adhesively attached to the inwardly facing edge 17 of each of the jambs 14. The jamb mounting elements 20 have the same thickness as do the jambs 14. As a result, once the jamb mounting elements 20 are installed, the effective width of each of the jambs 14 has been increased by the width W3 of the jamb mounting elements 20.

The back edge 21 of each of the jamb mounting elements 20 is flat so that the jamb mounting elements 20 can mount flush to the inwardly facing edge 17 of the jambs 14. The opposite front edge 23 of each jamb mounting element 20 is not flat. Rather, a groove 24 is formed along the entire length of each of the jamb mounting elements 20.

The trim mounting elements 30 are matched in pairs with the jamb mounting elements 20. For each jamb mounting element 20, there is a corresponding trim mounting element 30 that matches that jamb mounting element 20 in length. Extending from the rear edge of each trim mounting element 30 is a tongue 32. The tongue 32 is flush with the interior edge of each trim mounting element 30. As such, the presence of the tongue 32 forms a half-lap joint configuration along the length of each of the trim mounting elements 30. The tongue 32 on each trim mounting element 30 extends into the groove 24 of the opposite jamb mounting element 20, wherein the tongue 32 is free moving in and out of the groove 24. The groove 24 in each jamb mounting element 20 is as deep as the tongue 32 extending from each trim mounting element 30 is wide. As such, it will be understood that when joined, any section or all of the tongue 32 on the trim mounting elements 30 can be advanced into the groove 24 on the jamb mounting elements 20.

Since the tongue 32 on each trim mounting element 30 is free to move in and out of the jamb mounting elements 20, distance between the forward edge 31 of the trim mounting element 30 and the window jamb 14 can be selectively altered. Consequently, the trim mounting elements 30 can be selectively arranged so that the forward edge 31 of each trim mounting elements 30 terminates in the plane of the face surface of the wall 16.

The forward edge 31 of the trim mounting elements 30 are attached to the window trim 40 using nails, screw or adhesive. The window trim 40 is then mounted to the face surface of the wall 16 using conventional techniques. The result is that the jamb extension system 10 eliminates all gaps between the original window jambs 14 and the window trim 40 without the need for extensive carpentry.

Figure 2:
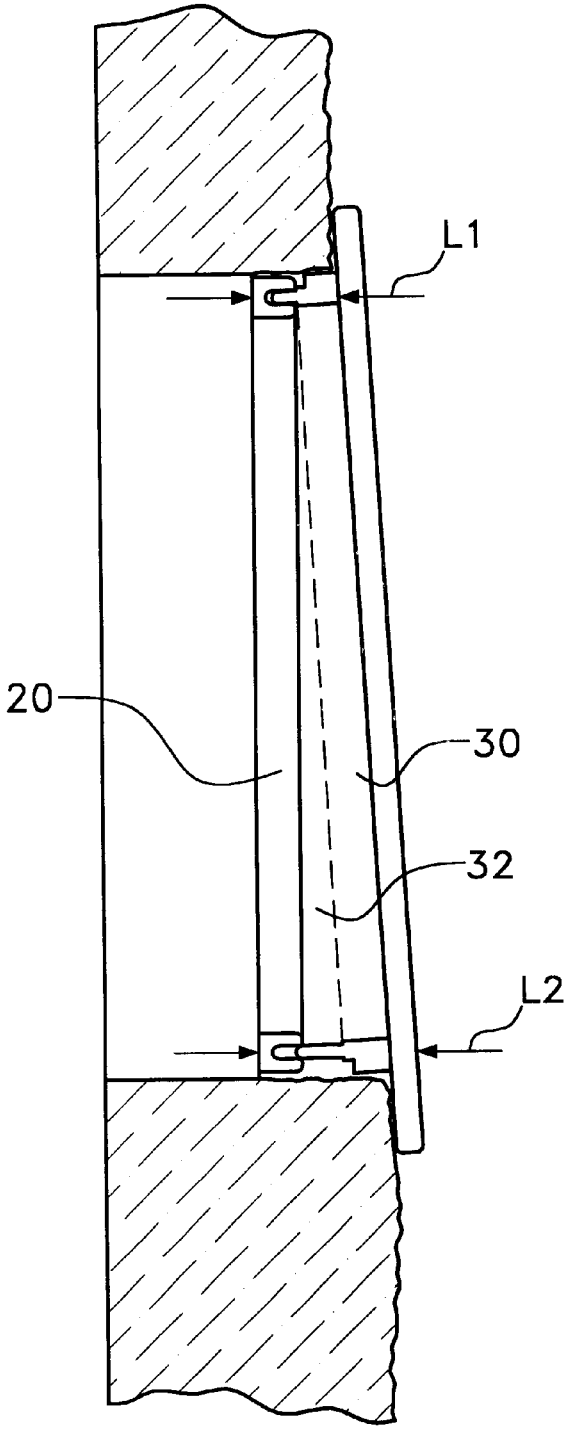
FIG. 2 is a side view of the system of FIG. 1.

Referring to FIG. 2, it can be seen that the depth to which the tongue 32 on the trim mounting element 30 extends into the groove 24 (FIG. 1) on the jamb mounting element 20 can vary along the length and width of the window. In the shown example, the combined jamb mounting element 20 and trim mounting element 30 have a combined length L1 at the top of the window. However, as the jamb mounting element 20 and the trim mounting element 30 progress down the window 12, these elements separate. Finally,at the bottom of the window 12, the combined jamb mounting element 20 and trim mounting element 30 have a length L2 which can be up to fifty percent larger than the top combined length L1. This enables the present invention system to work when installing windows and doors in walls having varying thicknesses.

Figure 3:
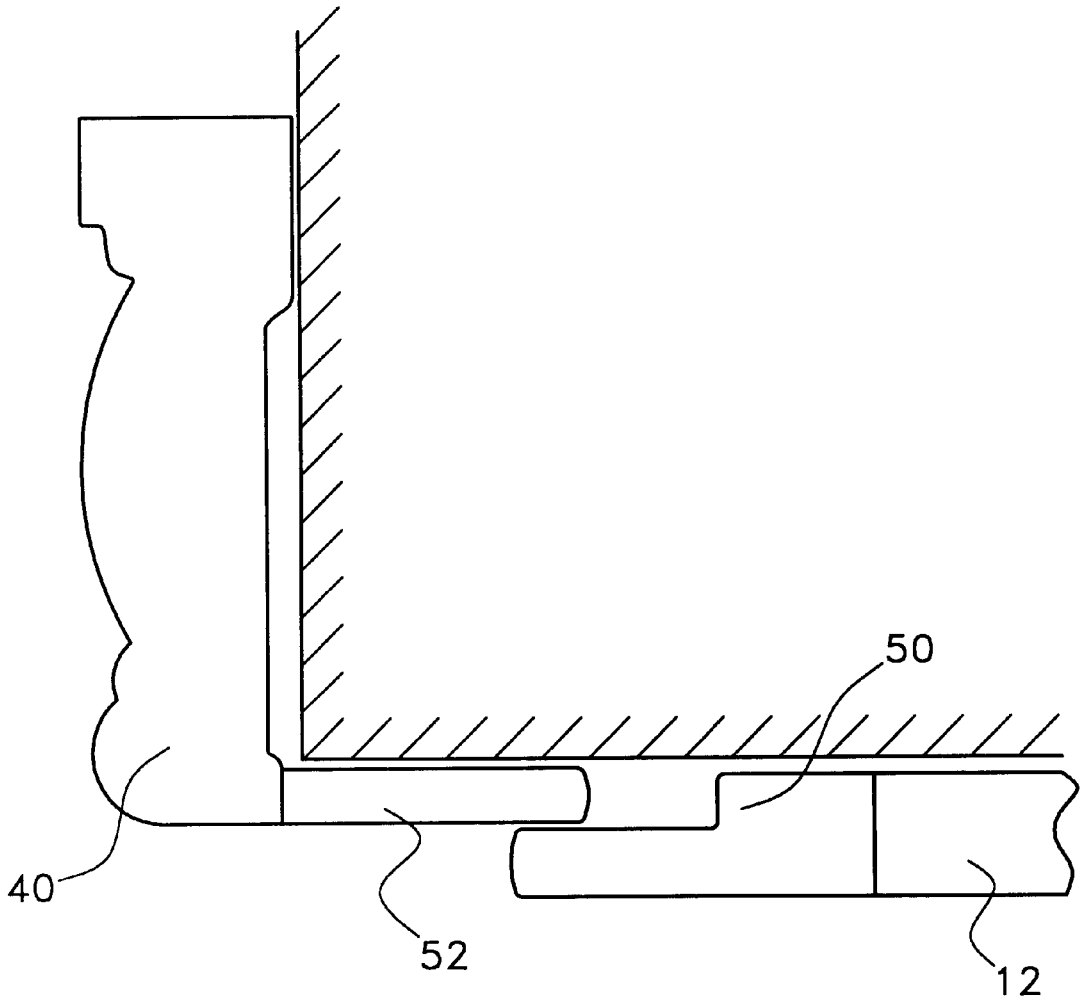
FIG. 3 is a fragmented cross-sectional view of an alternate embodiment of the present invention.

In the embodiment of the invention shown in FIG. 1, the jamb mounting elements 20 and the trim mounting elements 30 interconnect using a tongue and groove arrangement. Such an arrangement is merely exemplary and can be altered. Referring to FIG. 3, it can be seen that both the jamb mounting elements 50 can be manufactured with a half lap joint and the trim mounting element 52 can be a straight section of wood. The half lap joint of the jamb mounting elements 50 overlap the trim mounting elements 52 and prevent gaps from occurring between the jamb mounting elements 50 and the trim mounting elements 52 as these two elements are adjusted relative each other. As such, no gaps are left between the trim 40 and the window 12.

The system shown in FIG. 1 and FIG. 3, uses two separate elements to interconnect a section of window jamb 12 to the trim 40. Such a two piece system is preferred if the gap between the window 12 and the trim 40 is at least five centimeters long. However, in many installation applications, a carpenter may find that the jamb of a window or door many only be one or two centimeters out of alignment. In such situations, it is more practical to combine the trim and the trim mounting element into a single piece, in order to consume less space.

Figure 4:
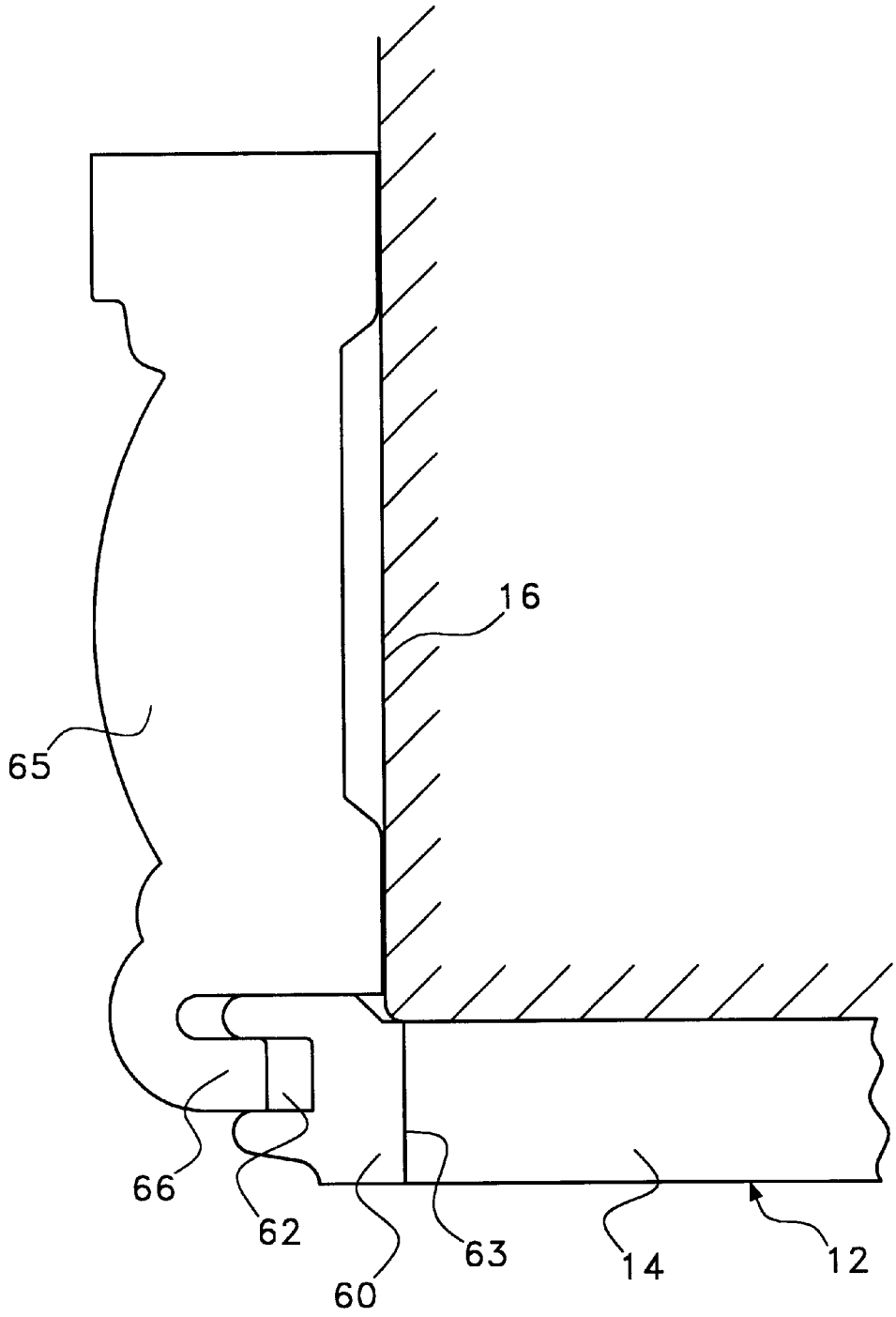
FIG. 4 is a fragmented cross-sectional view of a second alternate embodiment of the present invention.

Referring to FIG. 4, it can be seen that the system uses jamb mounting elements 60 that attach to the window jamb 14 in the manner previously described. Each jamb mounting element 60 contains a groove 62 that runs along the length of that jamb attachment element 60. The jamb mounting element 60 contains a flat back edge 63 so that the jamb mounting element 60 can be attached flush to the window jamb 14. The side and the front of the jamb mounting element 60 can be contoured so as to appear to be part of the trim 65 around the window 12.

In FIG. 4, there is no separate trim mounting element as there is in the embodiment of FIG. 1. Rather, in the shown embodiment, the trim 65 is custom routered in order to function as the trim mounting element. The back surface of the trim 65 is routered to form a tongue 66. The tongue 66 is sized to engage the groove 62 formed in the jamb mounting element 60. When the trim 65 is placed on the wall 16, the tongue 66 formed in the trim 65 passes into the groove 62 formed in the jamb mounting element 60. The contours of the trim 65 blend with the contours on the jamb mounting element 60, thereby creating the appearance of a solid segment of milled trim.

The tongue 66 extending from the trim 65 is free to move in and out of the groove 62 on the jamb mounting element 60 without creating a gap. As a result, if the plane of the original window jamb 14 does not align with the face surface of the wall 16, the misalignment can be compensated for by the jamb mounting element 60 and the tongue 66 of the trim 65 that extends into the jamb mounting element 60. The result is that the jamb extension system eliminates all gaps between the original window jambs 14 and the window trim 65 without the need for extensive carpentry.

It will be understood that the embodiments of the present invention described and illustrated herein are merely exemplary and a person skilled in the art can make many variations to the embodiments shown without departing from the scope of the present invention. All such variations, modifications and alternate embodiments are intended to be included within the scope of the present invention as defined by the appended claims.

What is claimed is:

1. In a construction application where a premanufactured window with jambs is being installed in a wall and the jambs are not as wide as the wall, an assembly for trimming the window flush with the wall comprising:

jamb mounting elements, each of said jamb mounting elements having a flat rear end for mounting against the jambs of the window, and an opposite forward end, wherein each said forward end extends outwardly beyond said wall when said flat rear end of each said jamb mounting element is mounted to a jamb;

trim elements for mounting flush on said wall, wherein each of said trim elements interconnects with said forward end of each of said jamb mounting elements when mounted flush on said wall.

2. The assembly according to claim 1, wherein said forward end of each of said jamb mounting elements and each of said trim elements interconnect with a tongue and groove configuration.

3. The assembly according to claim 1, wherein said trim elements have a rear surface that abuts against the wall when said trim elements are mounted to said wall, wherein a groove is disposed in each said rear surface that interconnects with said forward end of said jamb mounting elements.

4. The assembly according to claim 1 wherein said forward end of each of said jamb mounting elements has an end that lays exposed next to said trim elements when said trim elements engage said forward end of said jamb mounting elements, wherein each said edge is contoured to have the appearance of part of said trim elements.

5. The assembly according to claim 1, wherein each jamb mounting element has a predetermined length and thickness that matches one of the jambs on the window.

6. The assembly according to claim 1, wherein there is a trim mounting element that corresponds to each said trim elements.

7. The assembly according to claim 1, wherein said forward end of said jamb mounting elements defines a groove, and tongue extensions protrude from said trim elements, wherein said tongue extensions on said trim elements protrude into said groove in said jamb mounting elements when said trim elements are mounted flush on the wall.

8. A method of installing a window assembly into a wall, wherein the window assembly contains jambs, said method including the steps of:

placing the window assembly into an opening in a wall;

attaching extensions to the jambs of the windows, wherein said extensions extend beyond said wall;

attaching trim flush to said wall around said opening, wherein said trim engages said extensions with a tongue and groove configuration.

9. The method according to claim 8, wherein said step of attaching extensions to the jambs of the windows, includes attaching a jamb extension element to each jamb of the window.

10. The method according to claim 9, wherein each of said jamb extension extensions has a groove formed therein and each piece of trim has a protrusion that extends into said groove as the trim is attached to said wall.

11. A method of installing a trim framework around a window in a wall, wherein the window has mounting jambs that are not flush with the wall, said method including the steps of:

attaching jamb extension elements to the jambs of the window, wherein exposed portions of said jamb extension elements extend outwardly beyond the wall;

attaching trim elements to the wall around the window, wherein the trim elements overlaps said exposed portions of said jamb extension elements and said exposed portions of said jamb extension elements combine with sad trim to produce said trim framework around the window.

12. The method according to claim 11, wherein said trim elements engage said exposed sections of said jamb extension elements with a tongue and groove configuration.

* * * * *